US006378147B1

(12) United States Patent
Halleran

(10) Patent No.: US 6,378,147 B1
(45) Date of Patent: Apr. 30, 2002

(54) ROLL-UP INFLATABLE BATHTUB APPLIANCE

(76) Inventor: George Halleran, 46 S. Fellowship Rd., Maple Shade, NJ (US) 08052

( * ) Notice: Subject to any disclaimer, the term of this patent is extended or adjusted under 35 U.S.C. 154(b) by 0 days.

(21) Appl. No.: 09/823,964

(22) Filed: Mar. 28, 2001

(51) Int. Cl.[7] ..... A47K 3/12

(52) U.S. Cl. ..... 4/579; 4/571.1; 4/583; 297/16.1

(58) Field of Search ..... 4/579, 581, 582, 4/583, 611, 571.1, 573.1, 578.1; 5/706; 297/16.1, 351

(56) References Cited

U.S. PATENT DOCUMENTS

| | | | | |
|---|---|---|---|---|
| 3,835,483 A | * | 9/1974 | Emery et al. | 4/579 |
| 4,495,666 A | | 1/1985 | Herman, Jr. | |
| 5,020,168 A | | 6/1991 | Wood | |
| 5,806,110 A | | 9/1998 | Kunz et al. | |

FOREIGN PATENT DOCUMENTS

| | | | | |
|---|---|---|---|---|
| DE | 3408234 | * | 9/1985 | 5/706 X |
| GB | 2238470 | * | 6/1991 | 5/706 X |

* cited by examiner

*Primary Examiner*—Gregory L. Huson
*Assistant Examiner*—Kathleen J. Prunner
(74) *Attorney, Agent, or Firm*—Stuart M. Goldstein

(57) ABSTRACT

An appliance is provided for individuals, especially those with disabilities which render them incapable of readily getting into and out of a bathing position in a bathtub. The appliance consists of an inflatable seat with a top seat surface and side, back, front, and bottom walls made of a resilient material of single ply construction. The seat, when deflated, is flattened and crushed into a thin layer which can then be readily rolled into a compact unit and stored and transported in an accompanying carrying case. A bath mat type extension is secured to the front wall of the seat to supply a non-skid surface to the user while in the bathtub and for facilitating the roll-up aspect of the invention. The appliance employs the use of an air pump and air hose for supplying and delivering air to the seat, along with a valve for controlling the flow of air. A remotely operated device for controlling the operation of the air pump is also provided.

6 Claims, 3 Drawing Sheets

ROLL-UP INFLATABLE BATHTUB APPLIANCE

BACKGROUND OF THE INVENTION

Handicapped and disabled persons often find it difficult to take baths in the standard bathtubs in use today. Many such individuals have difficulty stepping into the bathtub, lowering themselves for a bath, and then getting out of the tub following the bathing procedure. Appliances which have been suggested in the past, such as that shown in U.S. Pat. No. 5,806,110, have addressed some, but not all of these problems. For instance, no device is currently available which is easily and readily configured to be set-up and taken down following use by handicapped or disabled individuals. None have been developed which are lightweight and stored and adopted to be transported following use. None provide a means for safe use of such an appliance on the slippery bottom surfaces of bathtubs.

SUMMARY OF THE INVENTION

It is thus an object of the present invention to overcome the disadvantages of the prior art.

It is an object of the present invention to provide a bathtub appliance which is comfortable, safe, and effective for use by handicapped individuals or persons with disabilities.

It is an object of the invention to provide a bathtub appliance which can readily be used in a bathtub by a handicapped or disabled individual and, once use is completed, can easily be taken down and removed from the bathtub.

It is the further object of the present invention to provide a bathtub appliance which is of lightweight construction so as to be easily carried and transported.

It is still another object of the present invention to provide a bathtub appliance which is readily rolled into a compact unit for storage and transporting in a carrying case, along with other components of the appliance.

It is still a further object of the present invention to provide a bathtub appliance which can safely be set up and taken down by handicapped individuals and persons with disability, without fear of their falling due to slippery conditions in the bathtub in which the appliance is being used.

These and other objects are accomplished by the present invention which comprises an appliance for individuals especially those with disabilities which render them incapable of readily getting into and out of a bathing position in a bathtub. The appliance consists of an inflatable seat with a top section forming a top seat surface and side, back, front, and bottom walls made of a resilient material of single ply construction. The seat, when deflated, is flattened and crushed into a thin layer which can then be readily rolled into a compact unit and stored and transported in an accompanying carrying case. A bath mat type extension is secured to the front wall of the seat to supply a non-skid surface to the user while in the bathtub and for facilitating the roll-up aspect of the invention. The appliance employs the use of an air pump and air hose for supplying and delivering air to the seat, along with a valve for controlling the flow of air. A remotely operated device for controlling the operation of the air pump is also provided.

The novel features which are considered as characteristic of the invention are set forth in particular in the appended claims. The invention, itself, however, both as to its design, construction, and use, together with the additional features and advantages thereof, are best understood upon review of the following detailed description with reference to the accompanying drawings.

DETAILED DESCRIPTION OF THE INVENTION

Figure 1:
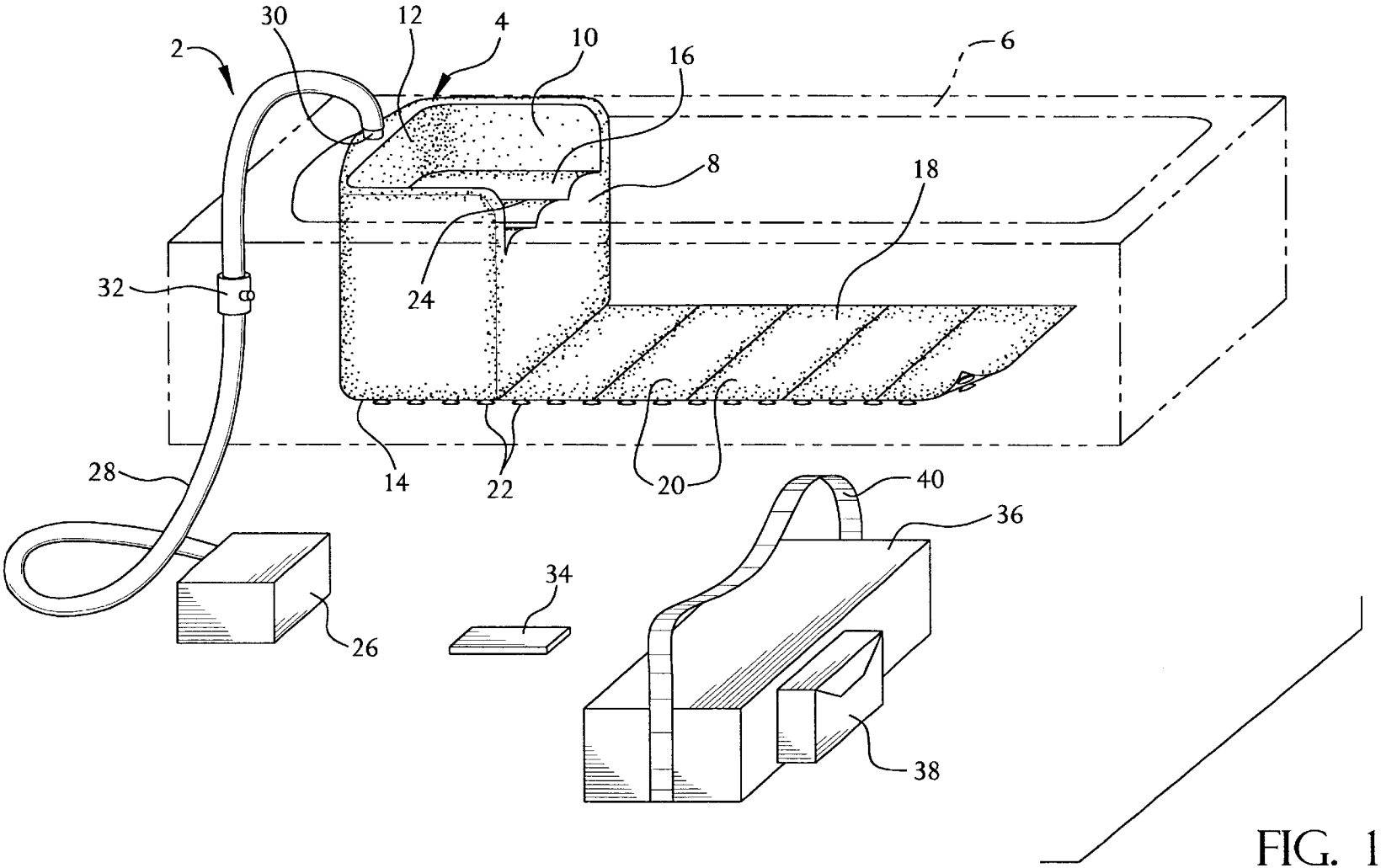
FIG. 1 shows the present invention in an inflated use condition in a bathtub.
Figure 2:
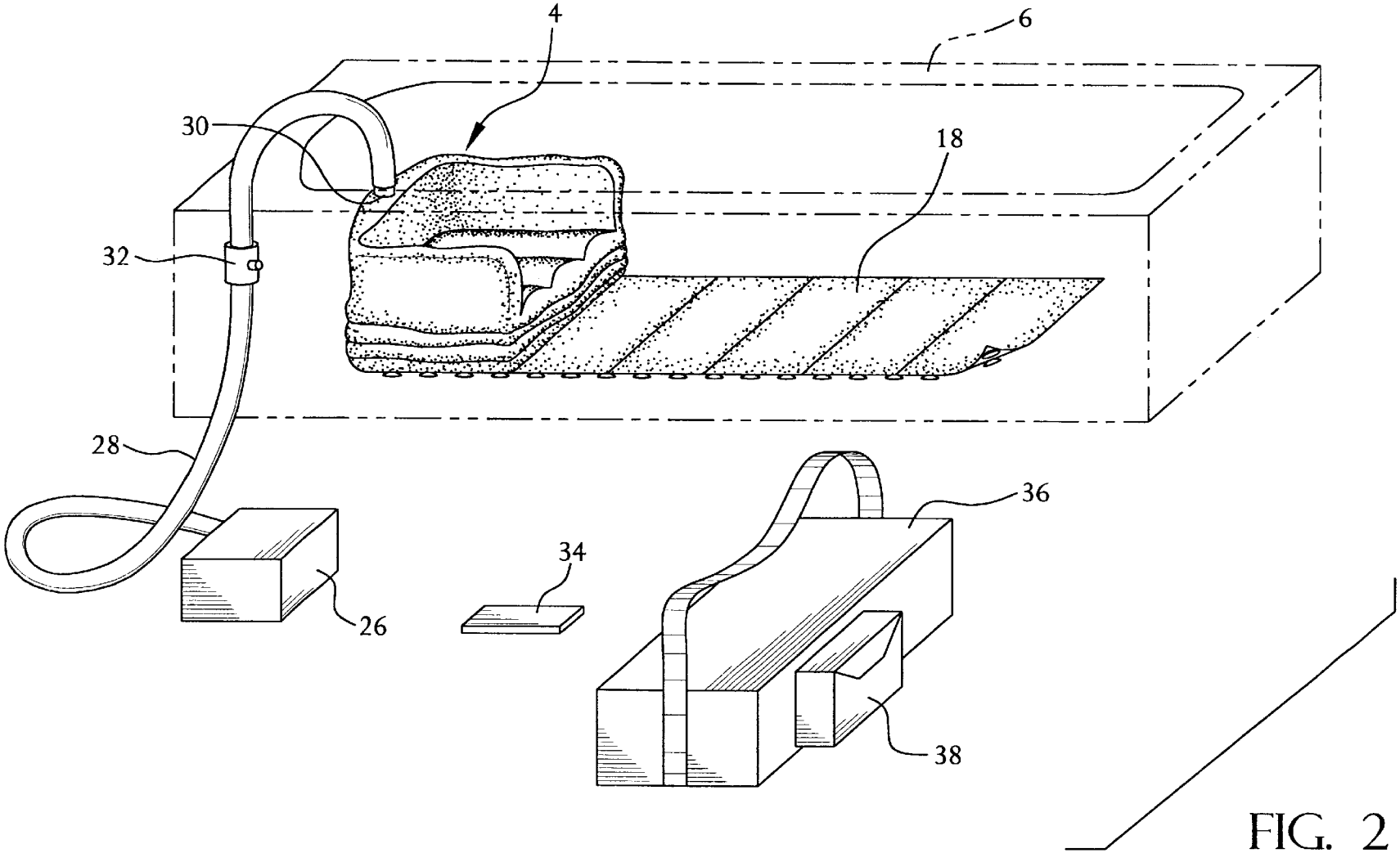
FIG. 2 shows the present invention in a deflated condition in a bathtub.
Figure 3:
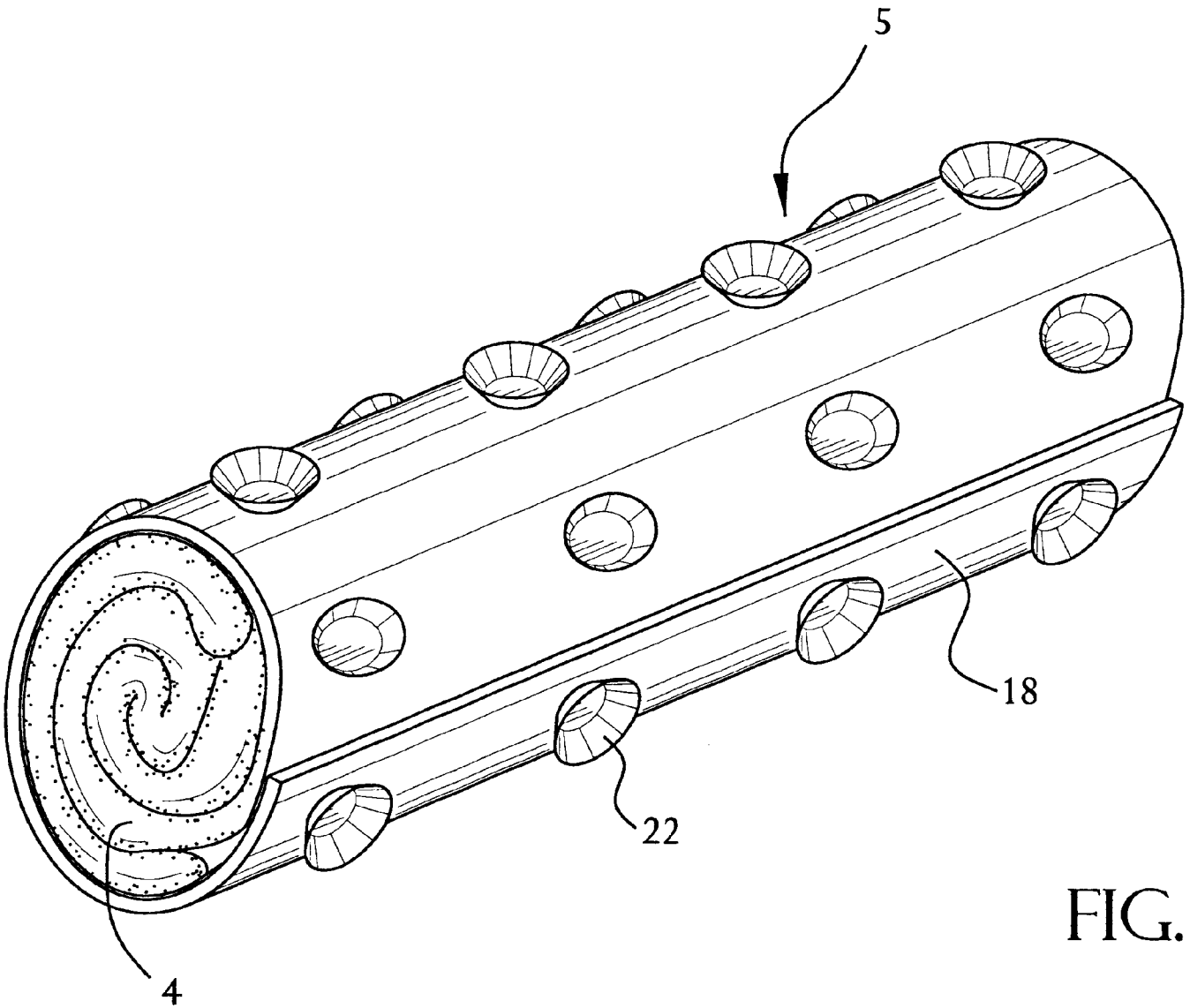
FIG. 3 shows the seat of the present invention rolled-up for storage.

Bathtub appliance 2 comprises an inflatable seat 4 configured to fit snugly into bathtub 6. Seat 4 comprises front wall 8, side walls 10, upraised back wall 12, bottom surface 14, and top seating surface 16. All wall surfaces of seat 4 are made of thin, resilient, single ply material, similar to that which is used in the construction of swimming pool rafts and tubes of such flexible, yet sturdy construction. The use of such material allows that when seat 4 is fully deflated, all walls and outer surfaces can be flattened and crushed together into a thin layer which can readily be rolled into a compact unit 5, as shown in FIG. 3.

Attached to front wall 8 is a bathtub styled mat 18 with jointed sections 20. It is contemplated that mat 18, when extended, will run from front wall 8 over the floor of bathtub 6. Suction attachment means such as a suction type cups 22, known in the art, are secured on the undersurface of mat 18 and bottom wall 14, to ensure stability and immobility of appliance 2 within bathtub 6.

Ridges 24, extending on top surface 16 from front wall 8 to back wall 12, provide for drain off of water which may accumulate on seat 4.

Air pump 26 is provided to supply pressurized air through hose 28 threadably or otherwise connected at 30 to the back wall 12 of seat 4. A three-way valve 32 is provided in hose 28 to regulate the flow of air through hose 28. Remote control unit 34 is further provided to allow the user to remotely control the operation of pump 26 when the user is on seat 4 in bathtub 6.

Carrying case 36 is a carrier case means for storing and transporting seat 4 when it is rolled up as compact unit 5. Carrying case 36 also has a storage compartment 38 for carrying pump 26, hose 28, and remote control unit 34.

In use, compact unit 5, consisting of rolled-up seat 4 and mat 18, is removed from carrying case 36, as is air pump 26, hose 28, and remote control 34. Compact unit 5 is unrolled to its full length or the length of bathtub 6 and placed on the floor of the bathtub. This can be done from a kneeling or standing position, allowing the handicapped person complete unassisted use of the invention. After hose 28 is connected to seat 4 at 30 and to air pump 26, seat 4 is filled with pressurized air from pump 26 while bathtub 6 is empty. The user then stands in bathtub 6 and sits on seat 4, as he or she would in any other chair. The user than operates regulatory valve 32 to slowly deflate seat 4. When seat 4 is deflated to the desired height, bathtub 6 is filled with water. Additional pressurized air may be added to seat 4 by using remote control 34 to control pump 26.

After completion of bathing, water is drained from bathtub 6 and seat 4 is again fully inflated by use of remote 4, operating air pump 26. The user can then easily stand up and step out of bathtub 6. He or she can operate valve 32 to fully deflate seat 4.

After appliance 2 is dried, it is removed from bathtub 6 and the front, side, back and bottom walls and top surface of seat 4 are flattened and crushed together into a thin layer which can then be again be rolled up. Mat 18 is rolled over deflated seat 4 and returned to its compact unit 5 configuration. Compact unit 5 is again stored in its carrying case 36 which is fitted with shoulder strap 40 for easy transport by any person, even an individual requiring crutches.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

I claim:

1. A readily transportable, roll-up, inflatable bathtub appliance, said appliance comprising:

(a) an inflatable seat for use by a bather in a bathtub, said seat comprising a top section and side, back, and front walls, the top section and each of the walls consisting solely of thin, yet resilient material of single ply construction, whereby when the seat is deflated, the seat is flattened and crushed together into a thin layer which can readily be rolled into a compact unit;

(b) means connected to and extending outwardly from the front wall of the seat for supplying a non-skid surface to the bathtub, said means configured to be rolled onto and around the rolled compact unit for transport of the appliance;

(c) an air pump for supplying air for the inflation of the seat;

(d) an air hose for delivering air from the pump to the seat;

(e) valve means for controlling the flow of air from the pump to the seat; and (f) remote operating means for controlling the air pump.

2. The bathtub appliance as in claim 1 in which the means connected to and extending from the front wall of the seat comprises an extendable mat with jointed sections configured to extend from the front wall of the seat outward onto a floor of the bathtub.

3. The bathtub appliance seat as in claim 1 further in which the top section is configured to accommodate a seated bather, said top section comprising ridges running from the front wall to the back wall to facilitate water drain off.

4. The inflatable bathtub appliance as in claim 1 in which the back wall rises above the top section of the seat and is configured for attachment to the air hose.

5. The bathtub appliance as in claim 1 further comprising carrier case means for storing and transporting the rolled compact unit, the air pump, the air hose, the valve means, and the remote operating means.

6. The bathtub appliance of claim 1 further comprising suction attachment means on a bottom wall of the seat and on the means connected to and extending from the front wall to maintain the seat in an immobile position in the bathtub.

* * * * *